US007513799B1

(12) United States Patent
Goldman

(10) Patent No.: US 7,513,799 B1
(45) Date of Patent: Apr. 7, 2009

(54) LIGHTWEIGHT ELECTRICAL CONNECTOR SPLIT BACKSHELL

(75) Inventor: Elliot Goldman, Littleton, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/798,525

(22) Filed: May 15, 2007

(51) Int. Cl.
*H01R 9/03* (2006.01)

(52) U.S. Cl. ..... 439/610

(58) Field of Classification Search ..... 439/607, 439/608–610, 357–358, 489, 347, 490, 188, 439/752

See application file for complete search history.

(56) References Cited

U.S. PATENT DOCUMENTS 4,653,836 A * 3/1987 Peele ..... 439/610
4,941,849 A 7/1990 Fujiura
4,961,711 A 10/1990 Fujiura et al.
5,055,070 A 10/1991 Plegge et al.
5,199,903 A 4/1993 Asick et al.
5,319,156 A 6/1994 Fonteneau et al.
5,409,400 A 4/1995 Davis
5,505,637 A 4/1996 Kramer et al.
5,703,754 A 12/1997 Hinze
6,146,205 A * 11/2000 Lai ..... 439/610
6,454,577 B1 9/2002 Yi
6,705,894 B1 * 3/2004 Comerci et al. ..... 439/607
6,899,554 B1 * 5/2005 Osada ..... 439/157

* cited by examiner

*Primary Examiner*—Jean F Duverne
(74) *Attorney, Agent, or Firm*—McDermott Will & Emery LLP

(57) ABSTRACT

An electrical connector split backshell is provided, comprising two substantially identical backshell halves. Each half includes a first side and a cam projecting therefrom along an axis perpendicular thereto, the cam having an alignment tooth with a constant radius and an engagement section with a radius that increases with angular distance from the alignment tooth. Each half further includes a second side parallel to the first side and a circular sector opening disposed in the second side, the circular sector opening including an inner surface configured as a ramp with a constant radius, the ramp being configured to engage with an engagement section of a cam of the other half, the circular sector opening further including a relieved pocket configured to receive an alignment tooth of the cam of the other half. Each half further includes a back side perpendicular to the first and second sides and a wire bundle notch disposed in the back side, the wire bundle notch configured to align with a wire bundle notch of the other half to form a wire bundle opening. The two substantially identical halves are rotatably coupled by engaging the engagement section of each half to the ramp of the other half.

20 Claims, 10 Drawing Sheets

LIGHTWEIGHT ELECTRICAL CONNECTOR SPLIT BACKSHELL

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Contract No. 263455332100 awarded by the National Aeronautics and Space Administration ("NASA").

CROSS-REFERENCE TO RELATED APPLICATION

Not applicable.

FIELD OF THE INVENTION

The present invention generally relates to electrical connectors and, in particular, relates to split backshells for enclosing electrical connectors.

BACKGROUND OF THE INVENTION

Backshells are used to provide electrical shielding and physical protection for electrical connectors in any number of applications. Split backshells are preferred in many applications, due to the ease with which they can be installed and removed. For weight- and mass-sensitive applications, however, the steel screws and threaded lugs that are required to secure these split backshells render them unacceptably heavy. One approach to providing lightweight backshells involves installing single-piece backshells into a cable assembly at the time of fabrication. These single-piece backshells are difficult, if not impossible, to remove from the cable assemblies after installation.

SUMMARY OF THE INVENTION

The present invention solves the foregoing problems by providing a split backshell for electrical connectors that is lightweight, fastenerless and inexpensive to manufacture. Two substantially identical hermaphroditic backshell halves are provided, each having a cam and a ramp on opposite sides. The two halves are rotatably coupled by engaging the cam of each backshell half with the ramp of the other half. The cam of each backshell half is configured to provide enough static friction with the ramp of the other half to secure the backshell without any additional fasteners. Because the two halves are substantially identical, manufacturing and assembly costs are greatly reduced.

According to one embodiment of the present invention, an electrical connector split backshell comprises two substantially identical backshell halves, each backshell half including a first side and a cam projecting from the first side along an axis perpendicular to the first side, the cam having an alignment tooth with a constant radius and an engagement section with a radius that increases with angular distance from the alignment tooth. Each backshell half further includes a second side parallel to the first side and a circular sector opening disposed in the second side, the circular sector opening including an inner surface configured as a ramp with a constant radius, the ramp being configured to engage with an engagement section of a cam of the other backshell half, the circular sector opening further including a relieved pocket configured to receive an alignment tooth of the cam of the other backshell half. Each backshell half further includes a back side perpendicular to the first and second sides and a wire bundle notch disposed in the back side, the wire bundle notch configured to align with a wire bundle notch of the other backshell half to form a wire bundle opening. The two substantially identical backshell halves are rotatably coupled by engaging the engagement section of each backshell half to the ramp of the other backshell half.

According to another embodiment of the present invention, a backshell half comprises a first side and a cam projecting from the first side along an axis perpendicular to the first side, the cam having an alignment tooth with a constant radius and an engagement section with a radius that increases with angular distance from the alignment tooth. The backshell half further comprises a second side parallel to the first side and a circular sector opening disposed in the second side, the circular sector opening including an inner surface configured as a ramp with a constant radius, the ramp being configured to engage with an engagement section of a cam of another substantially identical backshell half, the circular sector opening further including a relieved pocket configured to receive an alignment tooth of the cam of the other substantially identical backshell half. The backshell half further comprises a back side perpendicular to the first and second sides and a wire bundle notch disposed in the back side, the wire bundle notch configured to align with a wire bundle notch of the other substantially identical backshell half to form a wire bundle opening.

According to another embodiment of the present invention, an electrical connector system comprises a wire bundle, an electrical connector coupled to the wire bundle, and a split backshell surrounding the electrical connector. The split backshell includes two substantially identical backshell halves, each backshell half having a first side a cam projecting from the first side along an axis perpendicular to the first side, the cam having an alignment tooth with a constant radius and an engagement section with a radius that increases with angular distance from the alignment tooth, a second side parallel to the first side, a circular sector opening disposed in the second side, the circular sector opening including an inner surface configured as a ramp with a constant radius, the ramp being configured to engage with an engagement section of a cam of the other backshell half, the circular sector opening further including a relieved pocket configured to receive an alignment tooth of the cam of the other backshell half, a back side perpendicular to the first and second sides and a wire bundle notch disposed in the back side, the wire bundle notch configured to align with a wire bundle notch of the other backshell half to form a wire bundle opening. The two substantially identical backshell halves are rotatably coupled by engaging the engagement section of each backshell half to the ramp of the other backshell half. The wire bundle passes through the wire bundle opening.

It is to be understood that both the foregoing summary of the invention and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate embodiments of the invention and together with the description serve to explain the principles of the invention. In the drawings.

DETAILED DESCRIPTION OF THE INVENTION

In the following detailed description, numerous specific details are set forth to provide a full understanding of the present invention. It will be apparent, however, to one ordinarily skilled in the art that the present invention may be practiced without some of these specific details. In other instances, well-known structures and techniques have not been shown in detail to avoid unnecessarily obscuring the present invention.

Figure 1:
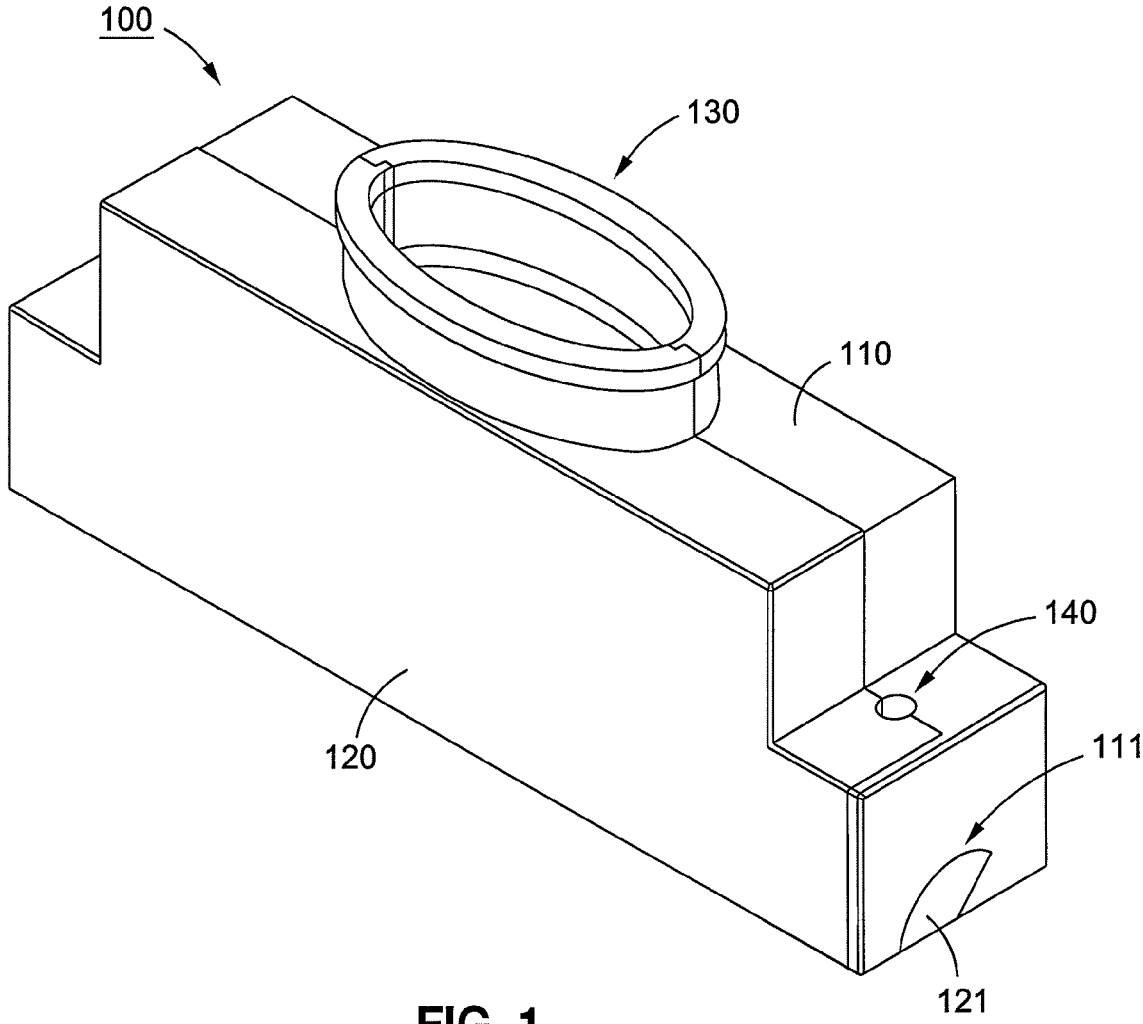
FIG. 1 illustrates an isometric view of an electrical connector split backshell according to one embodiment of the present invention.

FIG. 1 illustrates an isometric view of an electrical connector split backshell according to one embodiment of the present invention. Backshell 100 includes two substantially identical, hermaphroditic backshell halves 110 and 120. Each half includes a cam on one side and a ramp on the other for rotatably coupling the halves together. For example, in the present view, the cam 121 of half 120 is engaged with the ramp 111 of half 110. Each backshell half further includes a centered wire bundle notch in its backside and a curved structure extending therefrom, such that when the two halves are combined, a wire bundle throat 130 is provided. Similarly, each backshell half includes two smaller notches disposed on the two shoulders thereof, such that two alignment holes 140 are provided when the two halves are combined.

Figure 2A:
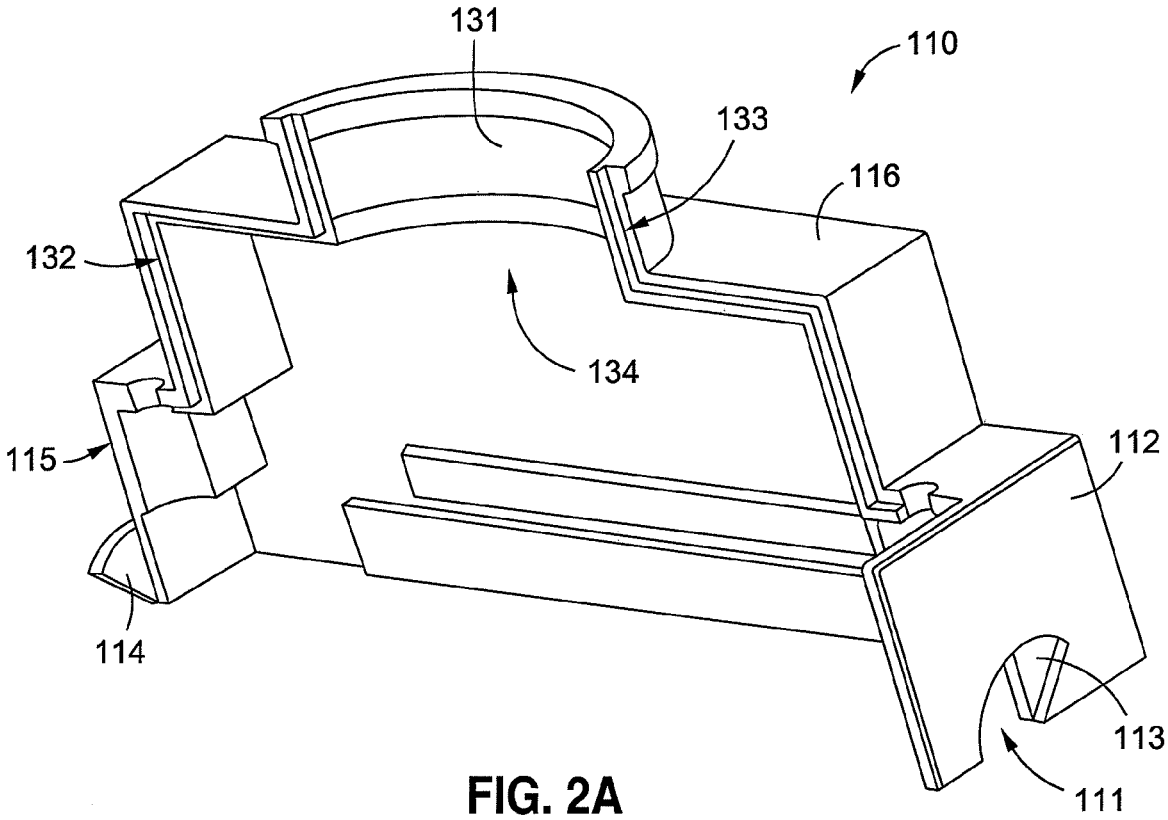
FIG. 2A illustrates an isometric view of the ramp side of one half of an electrical connector split backshell according to one embodiment of the present invention.
Figure 2B:
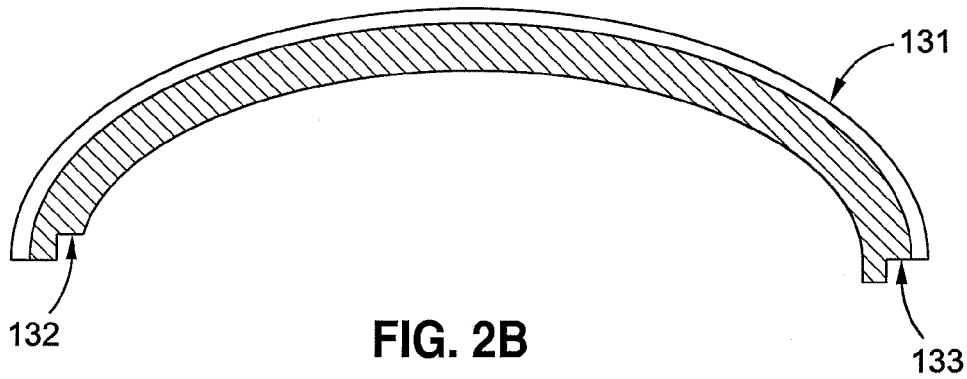
FIG. 2B provides a more detailed view of the wire bundle guide of one half of an electrical connector split backshell according to one embodiment of the present invention.

FIG. 2A illustrates backshell half 110 in greater detail, in accordance with one embodiment of the present invention. As indicated above, backshell half 110 is hermaphroditic—that is, backshell half 110 includes both a cam 114 and a ramp 111 on opposing sides (115 and 112, respectively). When mated with a substantially identical backshell half, cam 114 will rotatably engage with the ramp of the other half, and ramp 111 will rotatably engage with the cam of the other half. Backshell half 110 includes a back side 116 in which is centered a wire bundle notch 134. Wire bundle notch 134 is centered in back side 116 so that when backshell half is mated with a corresponding substantially identical backshell half, the wire bundle notch of the other half will align with wire bundle notch 134 to form a wire bundle opening, through which the wire bundle of an electrical connector can pass. Extending from back side 116 is a wire bundle trough 131, which forms, together with a corresponding wire bundle trough of another substantially identical backshell half, a wire bundle throat. As can be seen in greater detail with respect to FIG. 2B, notches 132 and 133 are provided along the mating edges of wire bundle trough 131. These notches permit corresponding wire bundle troughs to interlock when the two halves of a split backshell are mated together. Moreover, turning again to FIG. 2A, it can be seen that in this exemplary embodiment of the present invention, these notches 132 and 133 extend along many of the mating edges of backshell half 110. In this manner, backshell half 110 can be securely interlocked to a corresponding substantially identical backshell half.

Figure 3:
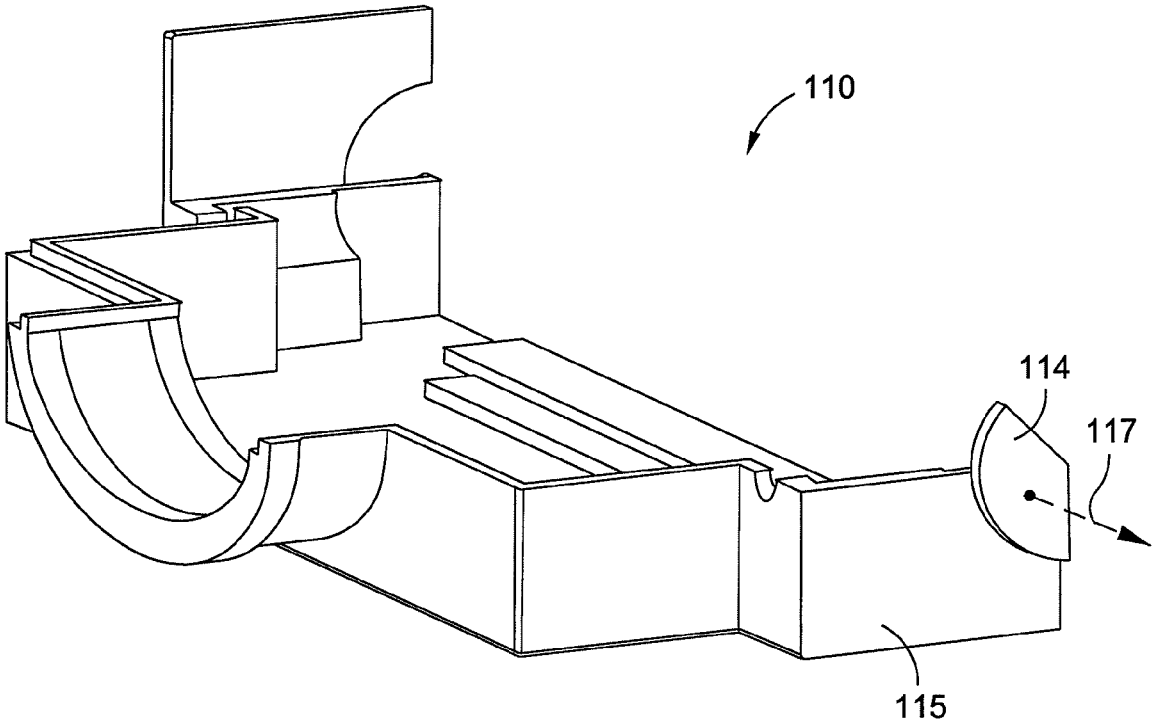
FIG. 3 illustrates a perspective view of the cam side of one half of an electrical connector split backshell according to one embodiment of the present invention.

FIG. 3 provides another isometric view of backshell half 110, in which cam 114 and side 115 can be seen in greater detail. As can be seen with reference to FIG. 3, cam 114 extends outwards from side 115 along an axis 117 which is perpendicular to side 115. For example, in the present exemplary embodiment, cam 114 extends outwards from side 115 0.041 inches, as will be illustrated in greater detail below, with respect to FIGS. 6A to 6C.

Figure 4A:
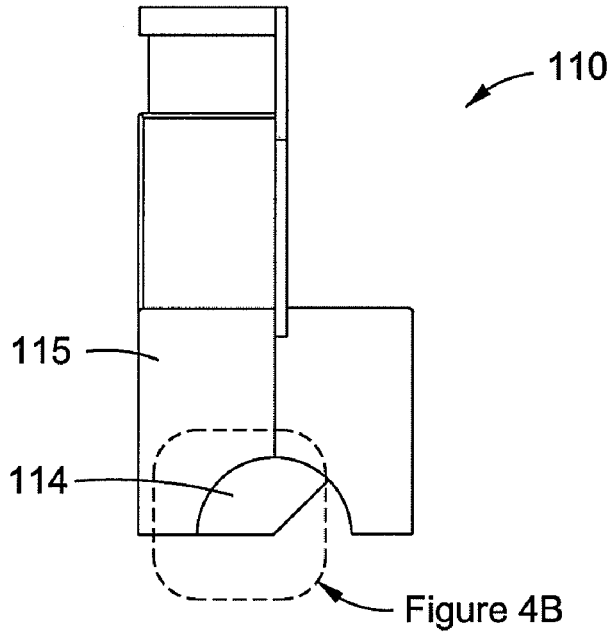
FIG. 4A illustrates a side view of the cam side of one half of an electrical connector split backshell according to one embodiment of the present invention.
Figure 4B:
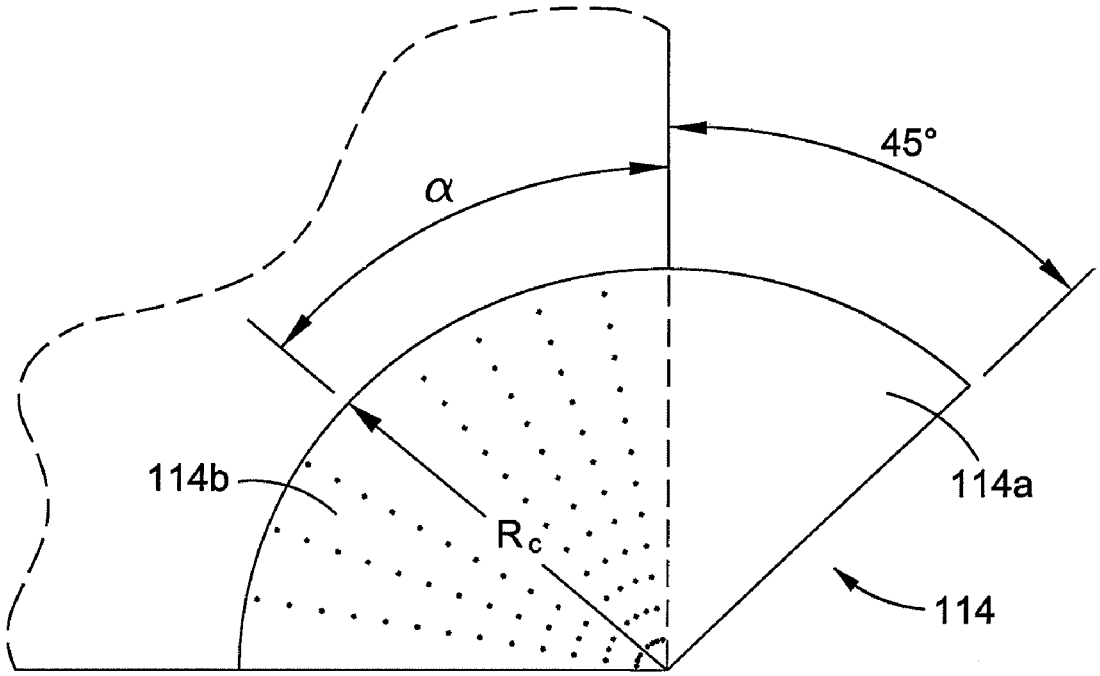
FIG. 4B provides a more detailed view of the cam of one half of an electrical connector split backshell according to one embodiment of the present invention.

Turning to FIGS. 4A and 4B, the configuration of cam 114 can be seen in even greater detail. FIG. 4A provides a view of backshell half 110 from side 115, from which cam 114 projects along an axis perpendicular to side 115. As can be seen in greater detail with respect to FIG. 4B, cam 114 includes an alignment tooth 114*a* in the shape of a circular sector (i.e., with a constant radius) with a central angle of 45°. In the present exemplary embodiment, the constant radius of the alignment tooth is 0.180 inches. Cam 114 further includes an engagement section 114*b* with a radius $R_c$ that increases with angular distance $\alpha$ from alignment tooth 114*a*. In the present exemplary embodiment, the radius $R_c$ of engagement section 114*b* is calculated according to the equation $R_c$=0.180"+K×sin($\alpha$), where K is a preload factor appropriate to the material from which backshell half 110 is constructed. For example, in the present exemplary embodiment, in which backshell half is manufactured from 6061 T6 aluminum, the preload factor K is 0.003. This preload value prevents local yielding of cam 114 and the corresponding ramp with which it is engaged when backshell half 110 is mated with a substantially identical backshell. Accordingly, at the junction between engagement section 114*b* and alignment tooth 114*a*, where $\alpha$=0, the radius $R_c$ of engagement section 114*b* is equal to 0.180 inches. At the extreme edge of engagement section 114*b*, where $\alpha$=90 (or, alternatively, $\alpha=\pi/2$), the radius $R_c$ of engagement section 114*b* is equal to 0.183 inches.

While the foregoing exemplary embodiment has been described with reference to an alignment tooth with a central angle of 45° and an engagement section with a central angle of 90°, the scope of the present invention is not limited to this particular arrangement. Rather, the present invention has application to cams with alignment teeth and engagement sections of any central angle, and even to cams having no alignment teeth at all. Similarly, while the foregoing exemplary embodiment has been described with reference to a backshell half constructed from aluminum, and with particular dimensions and preload factors, the scope of the present invention is not limited to this particular arrangement. Rather, the present invention has application to backshell halves of any size, composition, and preload factor.

Figure 5A:
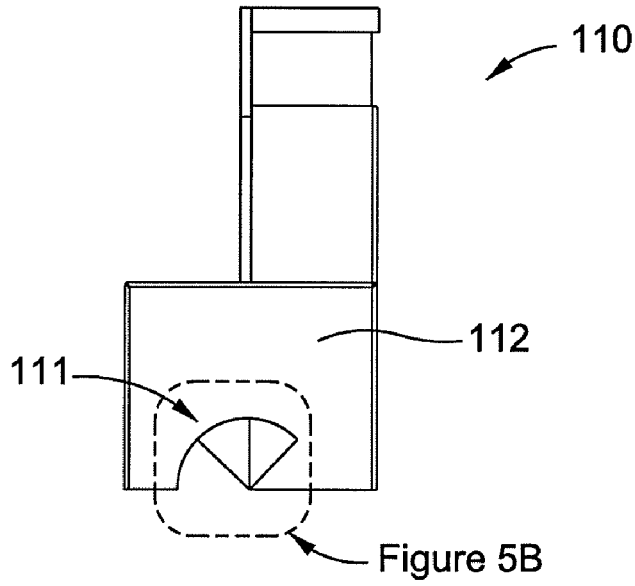
FIG. 5A illustrates a side view of the ramp side of one half of an electrical connector split backshell according to one embodiment of the present invention.
Figure 5B:
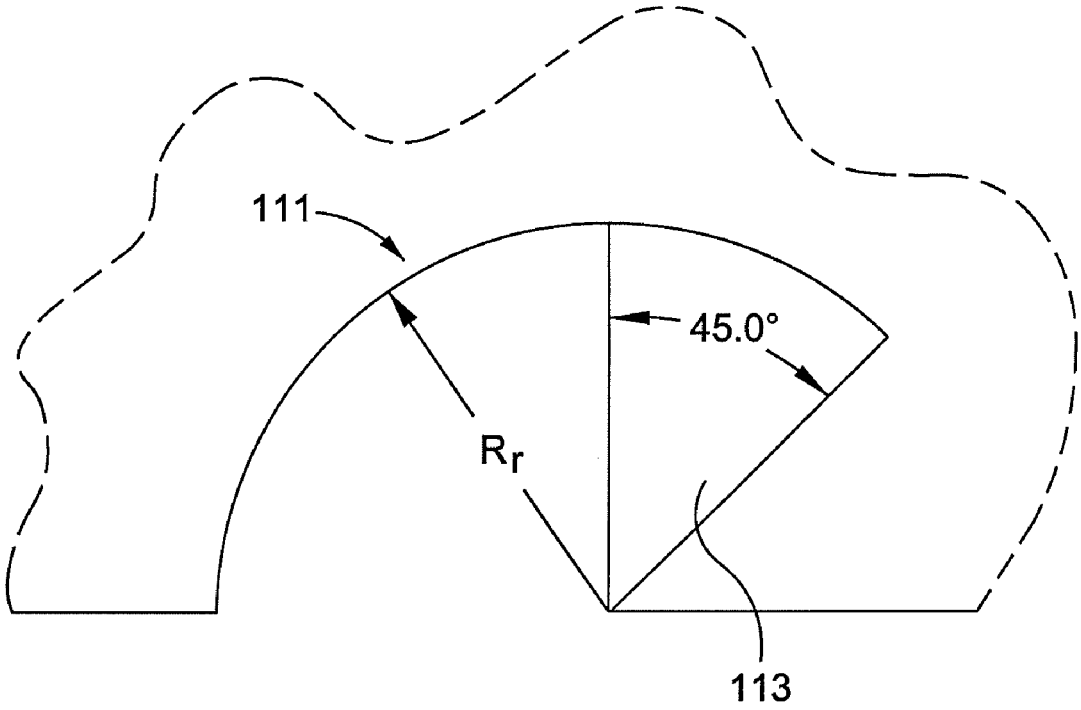
FIG. 5B provides a more detailed view of the ramp of one half of an electrical connector split backshell according to one embodiment of the present invention.

Turning to FIGS. 5A and 5B, the configuration of ramp 111 can be seen in even greater detail. FIG. 5A provides a view of backshell half 110 from side 112, in which is disposed a circular sector opening. An inside edge of the circular sector opening is configured as ramp 111. As can be seen in greater detail with respect to FIG. 5B, ramp 111 has a constant radius $R_r$ to allow ramp 111 to tightly engage with the engagement section of the cam of the corresponding backshell half. For example, in the present exemplary embodiment, ramp 111 has a constant radius $R_r$ of 0.182 inches. As described in greater detail above, engagement section 114*b* of ramp 114 (which is substantially identical to the ramp of the corresponding backshell half with which backshell half 110 will mate) has a maximum radius of 0.183" when $\alpha$=90°. Thus, the portion of the corresponding engagement section with a radius of 0.183" will compressably couple with ramp 111, which has a constant radius of 0.182", such that the compression and concomitant static friction between ramp 111 and the corresponding cam (as well as the similar forces between cam 114 and its corresponding ramp) will secure backshell half 110 to its corresponding, substantially identical mate.

The circular sector opening in side 112 also includes a relieved pocket 113 configured to receive an alignment tooth of a cam of a corresponding, substantially identical backshell half. For example, relieved pocket 113 is shaped as a circular sector with a central angle of 45°, the same central angle as the circular sector that makes up alignment tooth 114*a* (which is substantially identical to the alignment tooth of the backshell half with which backshell half 110 will mate). Relieved pocket 113 thereby facilitates the alignment of a cam with the circular sector opening in side 112.

Figure 6A:
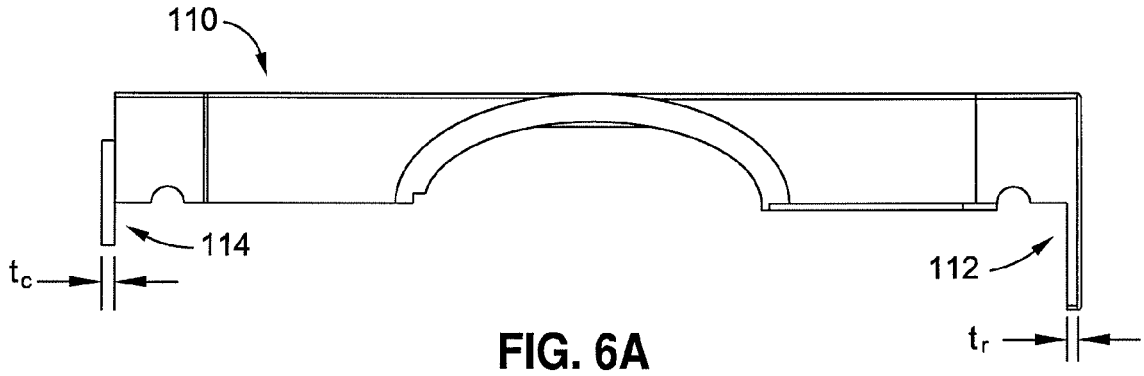
FIGS. 6A, 6B and 6C illustrate back, bottom and front views, respectively, of one half of an electrical connector split backshell according to one embodiment of the present invention.
Figure 6B:
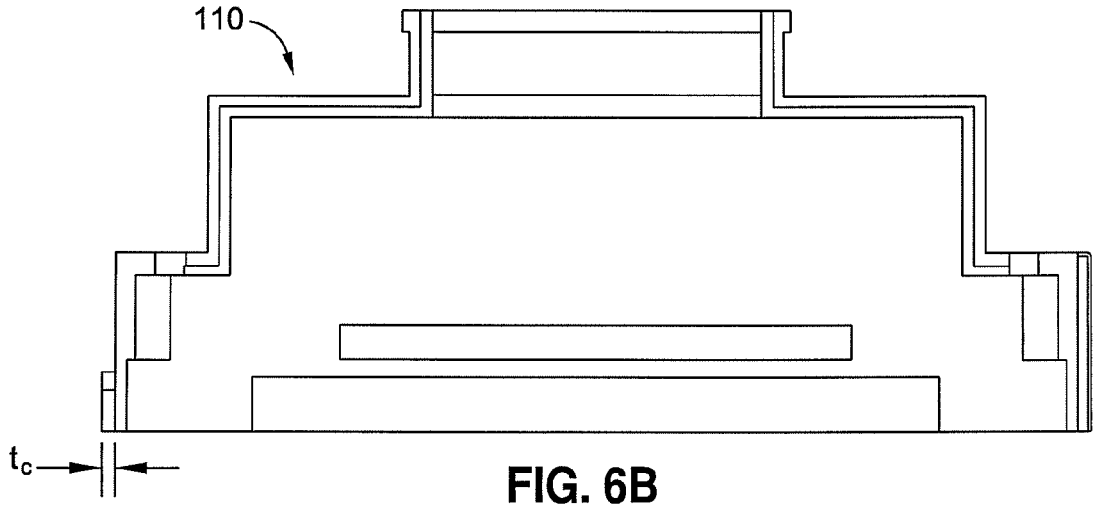
Figure 6C:
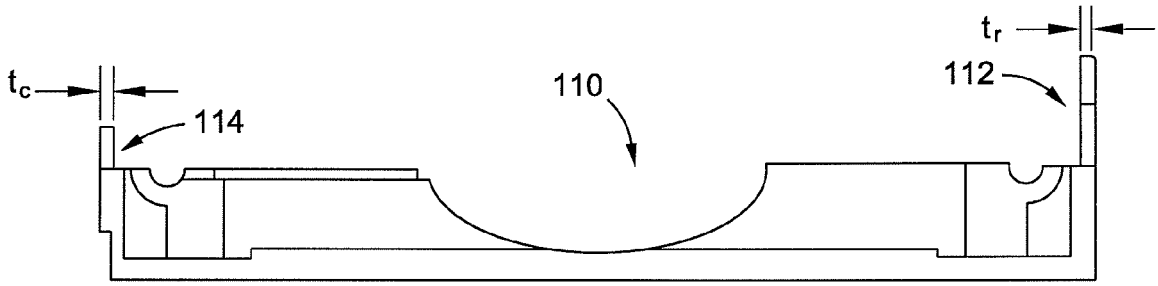

FIGS. 6A, 6B and 6C illustrate back, bottom and front views, respectively, of backshell half 110 in accordance with one embodiment of the present invention. As can be seen with reference to these figures, cam 114 extends along an axis perpendicular to side 115 for a distance $t_c$. For example, in the present exemplary embodiment, cam 114 has a thickness $t_c$ of 0.041 inches. The thickness of side 112, and accordingly, the thickness $t_r$ of ramp 111, is similarly indicated in these figures. In the present exemplary embodiment, ramp 111 has a thickness $t_r$ of 0.040 inches. Accordingly, when cam 114 is engaged with a corresponding ramp substantially identical to ramp 111, cam 114 will protrude slightly beyond an outside surface of the ramp side of the corresponding backshell half. This ensures that the entire thickness $t_r$ of the ramp will be engaged with cam 114.

While in the foregoing exemplary embodiment, specific dimensions have been given for the cams and ramps thereof, the scope of the present invention is not limited to these particular arrangements. Rather, the present invention has application to cams and ramps of any dimensions, including cams and ramps with the same thickness, or cams which are thinner than their corresponding ramps.

Figure 7:
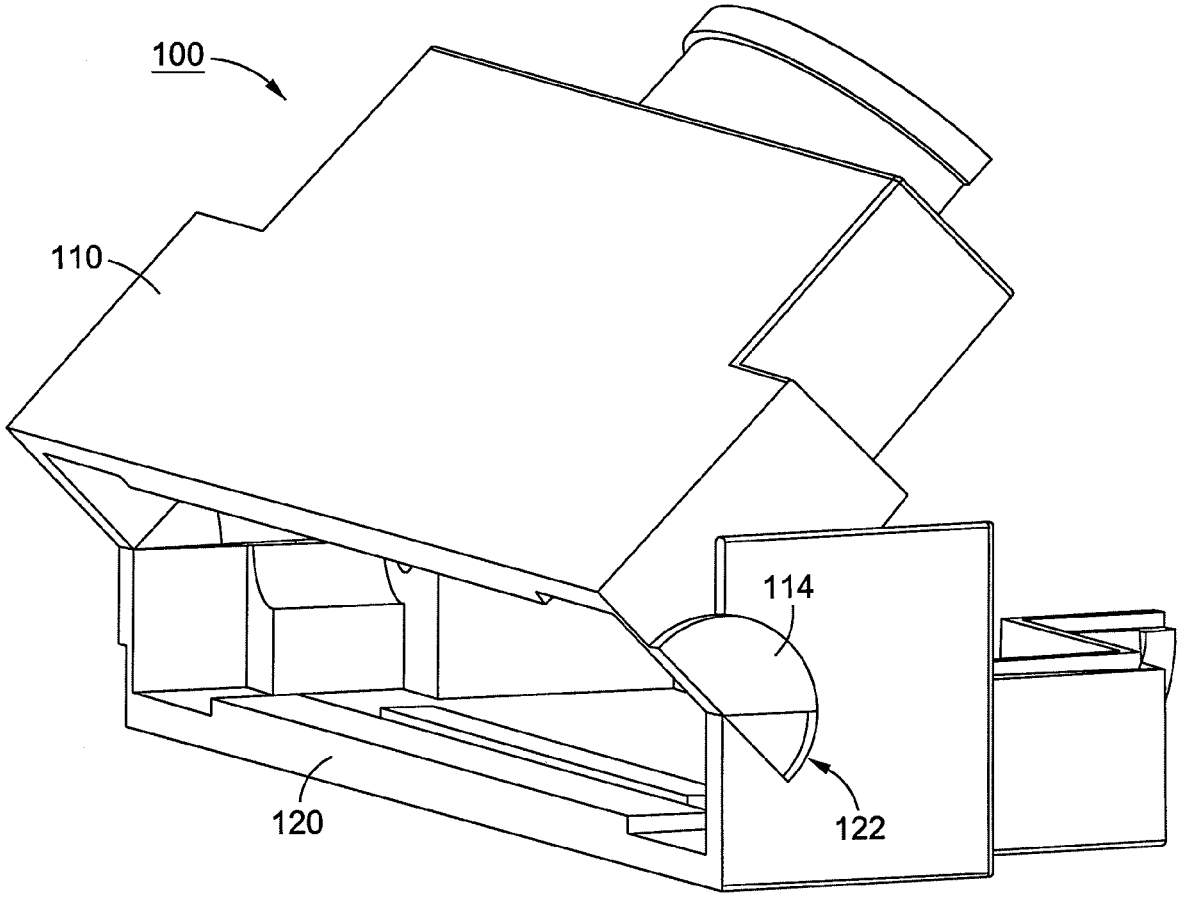
FIG. 7 illustrates a perspective view of an electrical connector split backshell in the open position according to one embodiment of the present invention.

FIG. 7 illustrates a perspective view of backshell 100 in an open position, in accordance with one embodiment of the present invention. As can be seen with reference to FIG. 7, backshell half 110 is rotatably coupled with backshell half 120 by rotatably engaging cam 114 of backshell half 110 with ramp 122 of backshell half 120 (and similarly engaging the cam of backshell half 120 with ramp 111 of backshell half 110, an engagement which is not visible from this perspective). In this open position, the portions of the cams which have the highest radius (i.e., those portions with the largest angular separation from the alignment teeth) are not engaged with their corresponding ramps. Accordingly, it will be relatively easy to begin closing the two halves 110 and 120. As the two halves 110 and 120 rotate shut, however, the increasing radius of each cam will begin to engage its respective ramp with greater force (e.g., compressive forces and both static and kinetic friction). Ultimately, when backshell 100 is in a fully closed position, the compressive and static friction forces will be maximized, and backshell 100 will be securely closed.

Figure 8A:
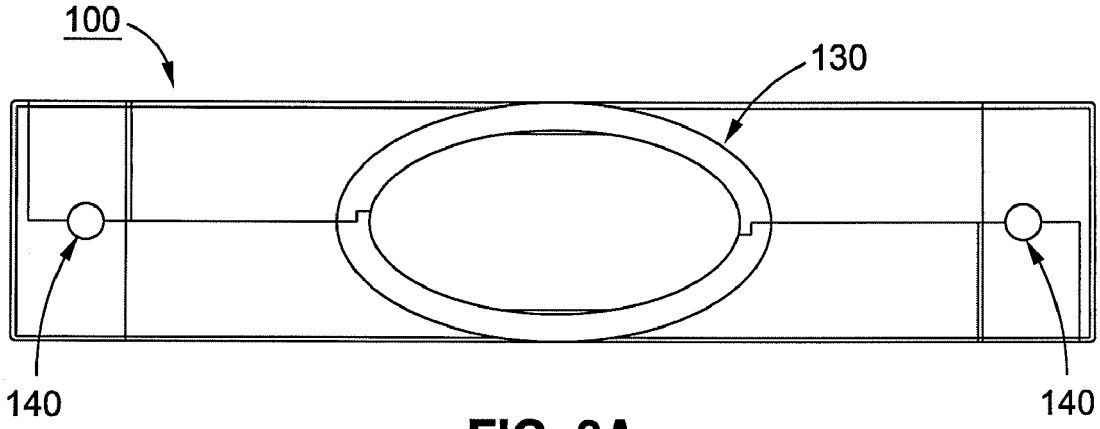
FIGS. 8A, 8B and 8C illustrate back, bottom and front views, respectively, of an electrical connector split backshell according to one embodiment of the present invention.
Figure 8B:
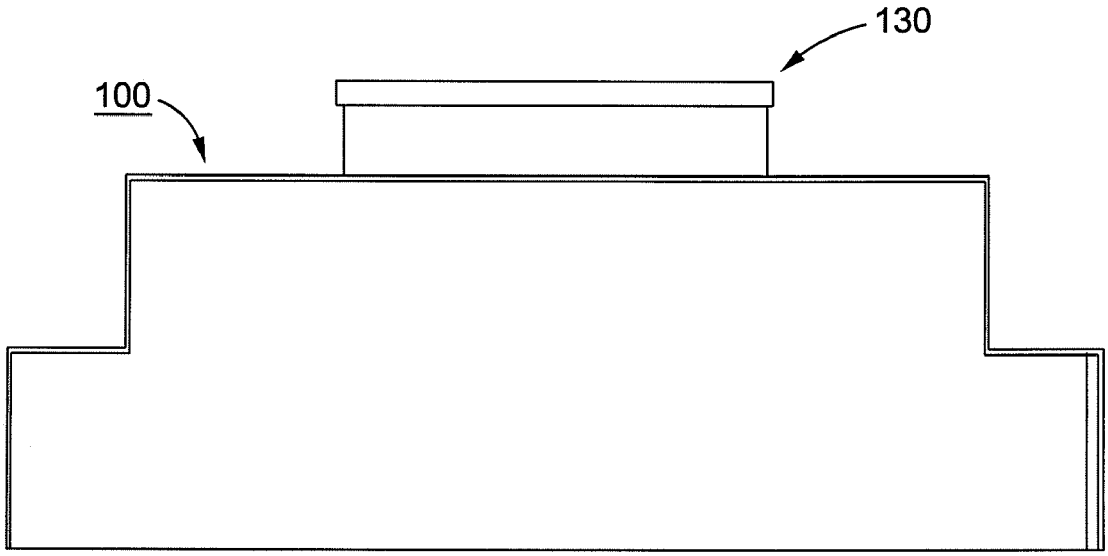
Figure 8C:
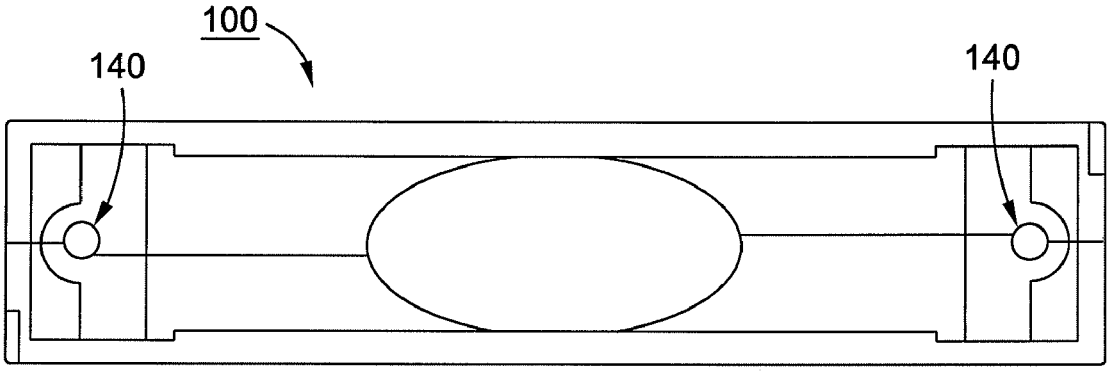

Turning to FIGS. 8A, 8B and 8C, back, bottom and front views of backshell 100 are respectively illustrated in accordance with one embodiment of the present invention. As can be seen with reference to FIG. 8A, wire bundle throat 130 is secured by the interlocking connection of the two halves thereof. Additionally, two alignment holes 140 are provided on back surfaces of backshell 100 for aligning backshell 100 with an electrical connector. These alignment holes can also be seen in FIG. 7, through the opening in the front of backshell 100 (as backshell 100 is illustrated here without any electrical connector enclosed therein). Depending upon the electrical connector to be enclosed, the spacing between alignment holes 140 and the dimensions thereof will vary. For example, in the present exemplary embodiment of the present application, suitable for use with a 37-pin D-subminiature ("DC-37") connectors (, the spacing between alignment holes 140 will be 32.10 mm. Alternatively, for a 15-pin D-sub ("DE-15") connector, the spacing between alignment holes 140 will be 18.2 mm. The scope of the present invention is not limited to these example shell sizes and configurations, however. As will be readily apparent to one of skill in the art, the present invention has application to split backshells in any shell size for electrical connectors of any configuration.

Figure 9A:
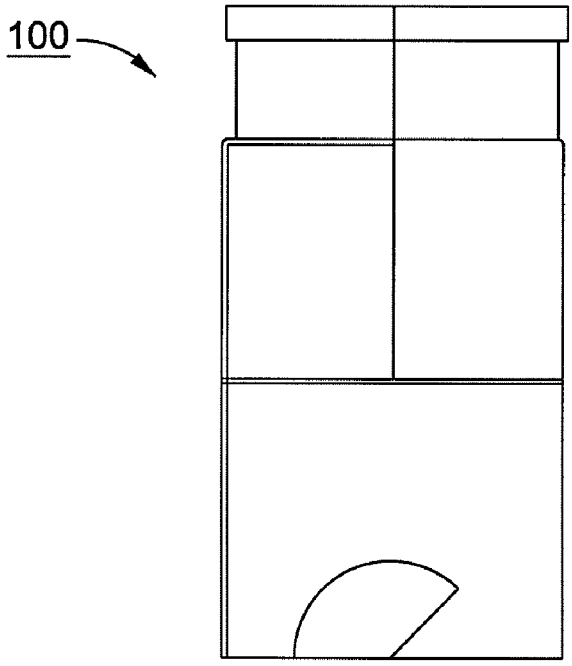
FIGS. 9A and 9B illustrate side views of an electrical connector split backshell according to various embodiments of the present invention.
Figure 9B:
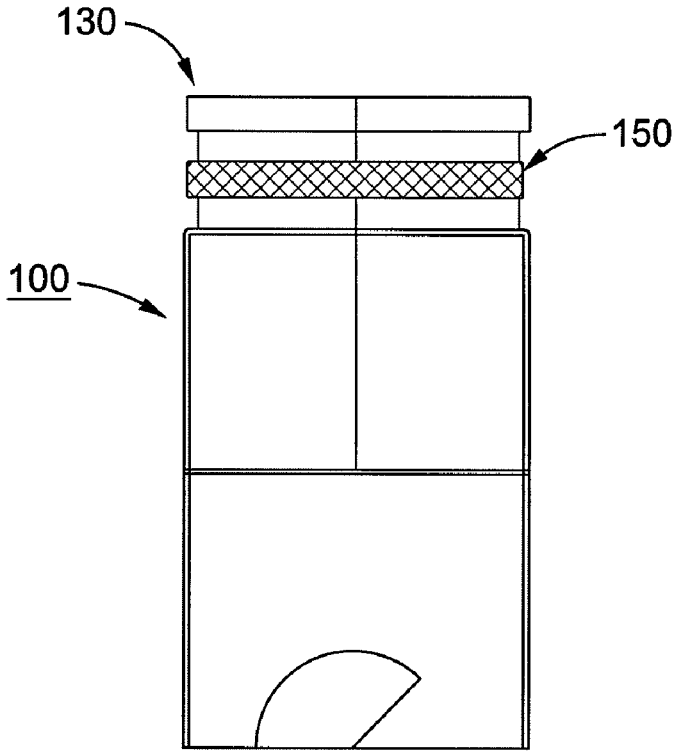

Turning to FIGS. 9A and 9B, side views of backshell 100 are illustrated in accordance with two alternative aspects of the present invention. In FIG. 9A, backshell 100 is illustrated in a closed position, wherein the compressive forces and static friction between the cams and respective ramps thereof secure backshell 100 in a closed position. In applications where the security of backshell 100 is paramount, however, a clamp band 150 can be secured around wire bundle throat 130, as shown in FIG. 9B. Together with the above-described forces engaging the cams and ramps of backshell 100, the tensile strength of clamp band 150 further ensures that backshell 100 remains in a closed position, even in a non-ideal environment (e.g., in which vibrations, sudden acceleration, or any other movement might tend to "wiggle" the cams and ramps free).

Figure 10:
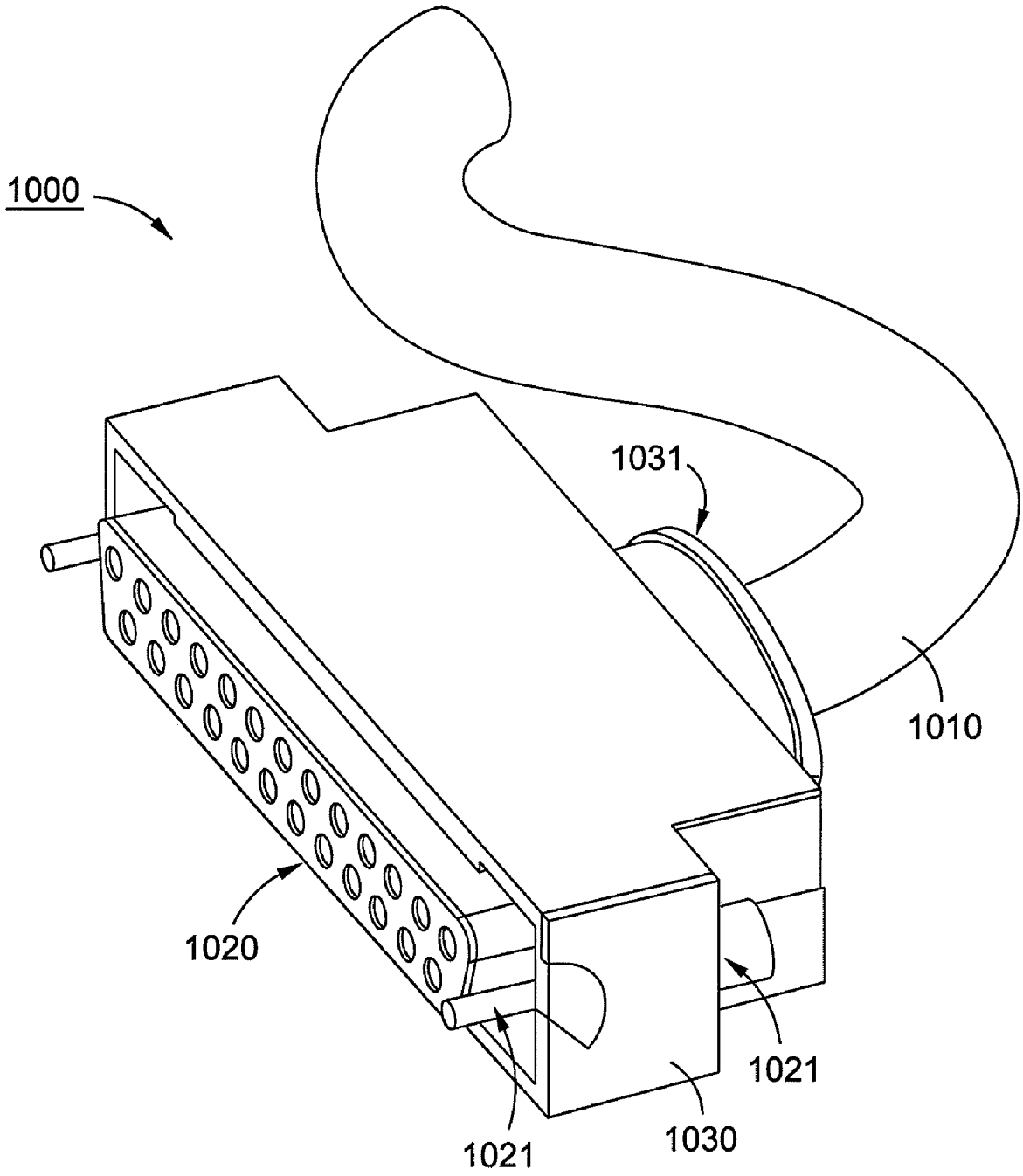
FIG. 10 illustrates an electrical connector system according to one embodiment of the present invention.

FIG. 10 illustrates an electrical connector system according to one embodiment of the present invention. Electrical system 1000 includes wire bundle 1010, which is connected to an electrical connector 1020, in this case a 15-pin DE-15 connector. Electrical connector 1020 is enclosed within split backshell 1030. Wire bundle 1010 passes through a wire bundle throat 1031 on a back surface of split backshell 1030. Electrical connector 1020 includes alignment pins such as alignment pin 1021, which pass through alignment holes in split backshell 1030 to secure electrical connector 1020 within split backshell 1030. Split backshell 1030 is comprised of two substantially identical backshell halves. In a fashion similar to that described in greater detail above with respect to backshell 100, the backshell halves of split backshell 1030 are rotatably coupled by engaging an engagement section of a cam of each backshell half to a ramp of the other backshell half.

While the present invention has been particularly described with reference to the various figures and embodiments, it should be understood that these are for illustration purposes only and should not be taken as limiting the scope of the invention. There may be many other ways to implement the invention. Many changes and modifications may be made to the invention, by one having ordinary skill in the art, without departing from the spirit and scope of the invention.

What is claimed is:

1. An electrical connector split backshell, comprising:

two substantially identical backshell halves, each backshell half including:

a first side;

a cam projecting from the first side along an axis perpendicular to the first side, the cam having an alignment tooth with a constant radius and an engagement section with a radius that increases with angular distance from the alignment tooth;

a second side parallel to the first side;

a circular sector opening disposed in the second side, the circular sector opening including an inner surface configured as a ramp with a constant radius, the ramp being configured to engage with an engagement section of a cam of the other backshell half, the circular sector opening further including a relieved pocket configured to receive an alignment tooth of the cam of the other backshell half;

a back side perpendicular to the first and second sides; and a wire bundle notch disposed in the back side, the wire bundle notch configured to align with a wire bundle notch of the other backshell half to form a wire bundle opening, wherein the two substantially identical backshell halves are rotatably coupled by engaging the engagement section of each backshell half to the ramp of the other backshell half.

2. The electrical connector split backshell of claim 1, wherein for each backshell half, the radius $R_c$ of the engagement section increases with an angular distance $\alpha$ from the alignment tooth according to the formula:

$$R_c=R_0+K\times\sin(\alpha),$$

where $R_0$ is the constant radius of the alignment tooth and K is a preload factor.

3. The electrical connector split backshell of claim 2, wherein K is 0.003.

4. The electrical connector split backshell of claim 1, wherein each backshell half further includes a wire bundle guide projecting from the wire bundle notch and configured to align with a wire bundle guide of the other backshell half to form a wire bundle throat.

5. The electrical connector split backshell of claim 4, further comprising a clamp band disposed around the wire bundle throat.

6. The electrical connector split backshell of claim 4, wherein the wire bundle guide of each backshell half includes a first notched surface extending perpendicular from the back side and a second notched surface parallel to the first notched surface, the first and second notched surfaces configured to align with second and first notched surfaces, respectively, of the other backshell half to interlock the wire bundle throat.

7. The electrical connector split backshell of claim 1, wherein each backshell half is composed of aluminum.

8. The electrical connector split backshell of claim 1, wherein the cam of each backshell half projects 0.041 inches along the axis.

9. The electrical connector split backshell of claim 1, wherein the constant radius of the ramp of each backshell half is 0.182 inches.

10. The electrical connector split backshell of claim 1, wherein the constant radius of the alignment tooth of each backshell half is 0.180 inches.

11. A backshell half comprising:

a first side;

a cam projecting from the first side along an axis perpendicular to the first side, the cam having an alignment tooth with a constant radius and an engagement section with a radius that increases with angular distance from the alignment tooth;

a second side parallel to the first side;

a circular sector opening disposed in the second side, the circular sector opening including an inner surface configured as a ramp with a constant radius, the ramp being configured to engage with an engagement section of a cam of another substantially identical backshell half, the circular sector opening further including a relieved pocket configured to receive an alignment tooth of the cam of the other substantially identical backshell half;

a back side perpendicular to the first and second sides; and a wire bundle notch disposed in the back side, the wire bundle notch configured to align with a wire bundle notch of the other substantially identical backshell half to form a wire bundle opening.

12. The backshell half of claim 11, wherein the radius $R_c$ of the engagement section increases with an angular distance $\alpha$ from the alignment tooth according to the formula:

$$R_c=R_0+K\times\sin(\alpha),$$

where $R_0$ is the constant radius of the alignment tooth and K is a preload factor.

13. The backshell half of claim 12, wherein K is 0.003.

14. The backshell half of claim 11, further comprising a wire bundle guide projecting from the back side and configured to align with a wire bundle guide of the other substantially identical backshell half to form a wire bundle throat.

15. The backshell half of claim 14, wherein the wire bundle guide includes a first notched surface extending perpendicular from the back side and a second notched surface parallel to the first notched surface, the first and second notched surfaces configured to align with second and first notched surfaces, respectively, of the other substantially identical backshell half to interlock the wire bundle throat.

16. The backshell half of claim 11, wherein the backshell half is composed of aluminum.

17. The backshell half of claim 11, wherein the cam projects 0.041 inches along the axis.

18. The backshell half of claim 11, wherein the constant radius of the ramp is 0.182 inches.

19. The backshell half of claim 11, wherein the constant radius of the alignment tooth is 0.180 inches.

20. An electrical connector system comprising:

a wire bundle;

an electrical connector coupled to the wire bundle; and a split backshell surrounding the electrical connector, the split backshell including:

two substantially identical backshell halves, each backshell half having:

a first side;

a cam projecting from the first side along an axis perpendicular to the first side, the cam having an alignment tooth with a constant radius and an engagement section with a radius that increases with angular distance from the alignment tooth;

a second side parallel to the first side;

a circular sector opening disposed in the second side, the circular sector opening including an inner surface configured as a ramp with a constant radius, the ramp being configured to engage with an engagement section of a cam of the other backshell half, the circular sector opening further including a relieved pocket configured to receive an alignment tooth of the cam of the other backshell half;

a back side perpendicular to the first and second sides; and a wire bundle notch disposed in the back side, the wire bundle notch configured to align with a wire bundle notch of the other backshell half to form a wire bundle opening, wherein the two substantially identical backshell halves are rotatably coupled by engaging the engagement section of each backshell half to the ramp of the other backshell half, and wherein the wire bundle passes through the wire bundle opening.

* * * * *